US005669858A

United States Patent [19]

Blair et al.

[11] Patent Number: 5,669,858

[45] Date of Patent: Sep. 23, 1997

[54] PORTABLE INFLATABLE STRUCTURE

[76] Inventors: Rodney Lee Blair, 11009 Dapple Way, Bakersfield, Calif. 93312; Philip G. Chauvet, 6644 Rippling Brook Dr., SE., Salem, Oreg. 97301

[21] Appl. No.: 546,719

[22] Filed: Oct. 23, 1995

Related U.S. Application Data

[60] Division of Ser. No. 354,359, Dec. 13, 1994, Pat. No. 5,462,505, which is a continuation-in-part of Ser. No. 134, 693, Oct. 12, 1993, abandoned.

[51] Int. Cl.[6] ..... A63B 21/00

[52] U.S. Cl. ..... 482/78; 482/74; 280/204; 440/100; 472/13

[58] Field of Search ..... 482/78, 127, 35; 280/206, 207; 472/134; 440/98, 99, 100, 21

[56] References Cited

U.S. PATENT DOCUMENTS

| | | | |
|---|---|---|---|
| 3,083,037 | 3/1963 | Gordon et al. | 482/78 |
| 4,298,197 | 11/1981 | Flagg | 482/78 |

FOREIGN PATENT DOCUMENTS

| | | | |
|---|---|---|---|
| 4227438 | 2/1994 | Germany | 482/35 |
| 500989 | 2/1939 | United Kingdom | 472/127 |

*Primary Examiner*—Jerome Donnelly
*Attorney, Agent, or Firm*—Robert M. Sperry

[57] ABSTRACT

An inflatable structure having a trampoline-type floor with an inflatable framework projecting upwardly therefrom and having netting panels extending between adjacent portions of said framework to prevent a child from inadvertently bouncing out of the structure, with at least one of said panels having releasable fastening means to allow opening of said one of said panels as a door.

8 Claims, 9 Drawing Sheets

PORTABLE INFLATABLE STRUCTURE

RELATED CASES

This application is a division of application Ser. No. 08/354 359 filed Dec. 13, 1994 now U.S. Pat. No. 5,462,505 which is a continuation-in-part of my patent application Ser. No. 08/134,093, filed Oct. 12, 1993 and now abandoned.

BACKGROUND

1. Field of the Invention

This invention relates to inflatable structures and is particularly directed to portable inflatable structures for indoor and outdoor use as exercise and play areas for children.

2. Prior Art

For several year, it has been known that numerous structures can be created by providing frameworks of hollow tubing and delivering a constant flow of low pressure air into such tubing to erect and maintain the erection of the framework. Moreover, panels of various materials can be secured to such frameworks to create closed buildings. Such inflatable structures have found considerable acceptance as temporary buildings for a wide variety of purposes. It has also been known to provide large inflatable mattresses for use as trampoline-type devices for the children's areas of amusement parks and the like. However, all of the prior art inflatable structures and trampoline-type devices have been designed for outdoor use. Consequently, these prior art inflatable structures have been relatively large and bulky. Because of this, these inflatable structures have not been considered suitable for indoor use. Furthermore, in an indoor environment, the inflatable trampoline-type devices have generally been considered to be unsafe, since a child bouncing on the device could fly off and strike nearby furniture, causing injury to the child and possible damage to the furniture.

BRIEF SUMMARY AND OBJECTS OF INVENTION

These disadvantages of the prior art are overcome with the present invention and improved inflatable structures are provided which are dimensioned for indoor use and which have a trampoline-type floor, yet which are completely safe for use in a confined area.

The advantages of the present invention are preferably attained by providing an inflatable structure having a trampoline-type floor with an inflatable framework projecting upwardly therefrom and having netting panels extending between adjacent portions of said framework to prevent a child from inadvertently bouncing out of the structure, with at least one of said panels having releasable fastening means to allow opening of said one of said panels as a door.

These and other objects and features of the present invention will be apparent from the following detailed description, taken with reference to the figures of the accompanying drawing.

DETAILED DESCRIPTION OF THE INVENTION

Figure 1:
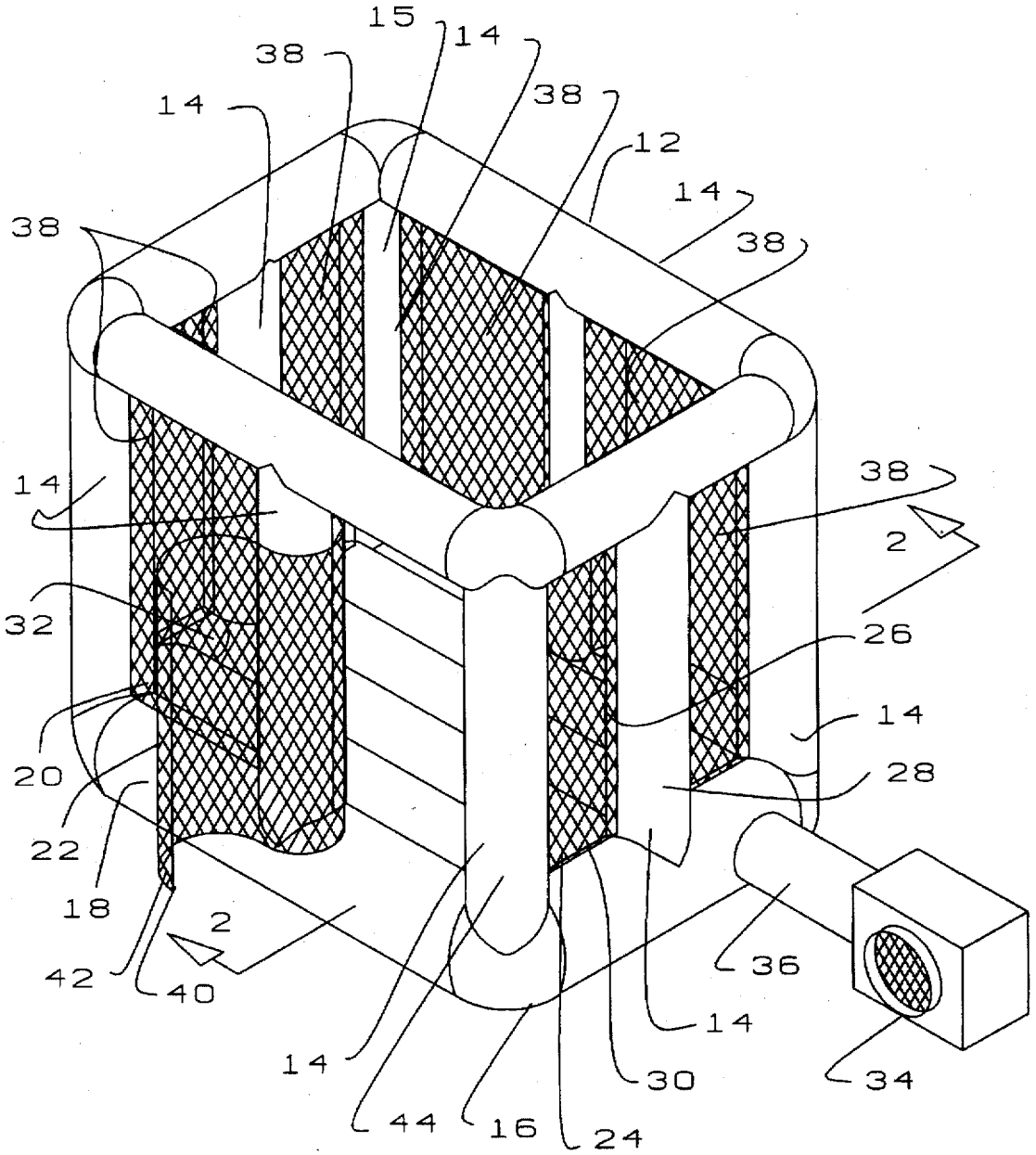
FIG. 1 is an isometric view of an inflatable structure embodying the present invention.
Figure 2:
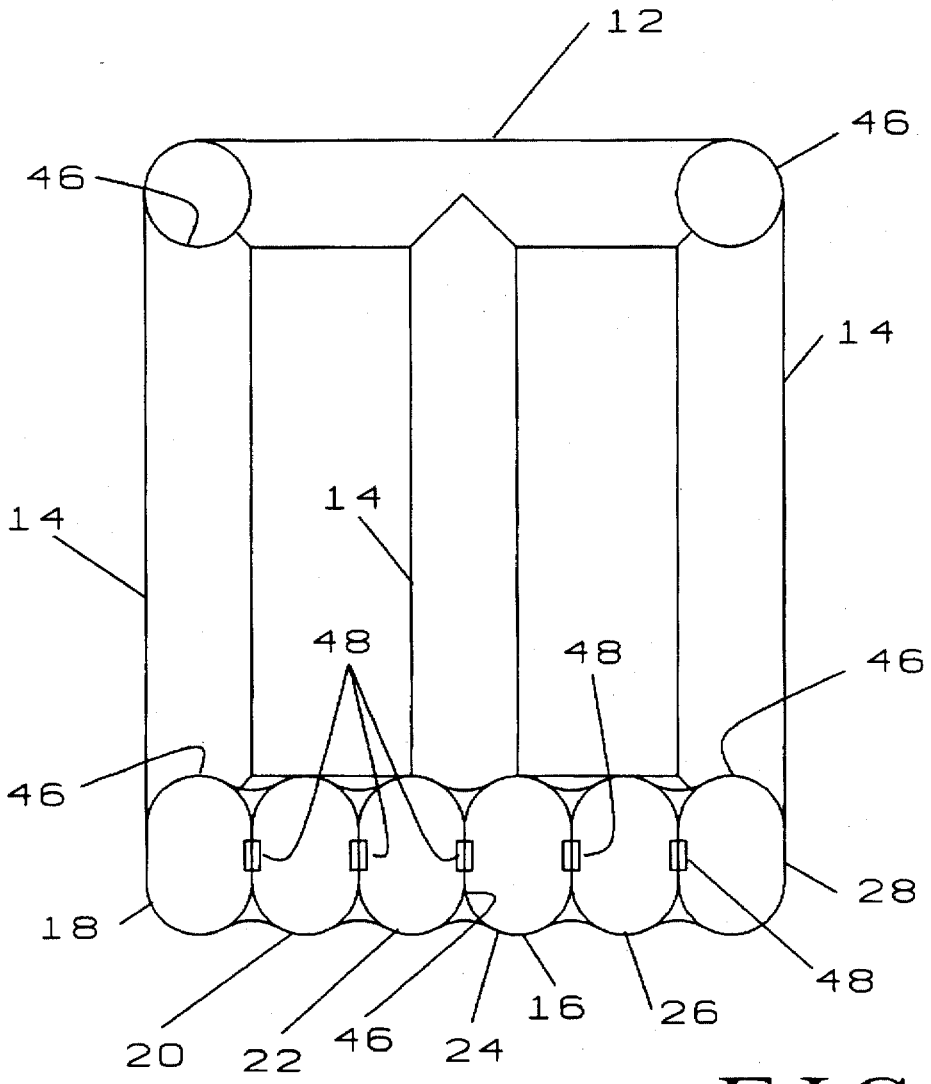
FIG. 2 is a transverse section through the base of the inflatable structure of FIG. 1 taken on the line 2—2 of FIG. 1.

In that form of the present invention chosen for purposes of illustration in the drawing, FIG. 1 shows an inflatable structure, indicated generally at 10, having a peripheral, generally rectangular upper tubular member 12, defining a central open area 15, supported by a plurality of spaced vertical tubular members 14, which each communicate with the upper member 12 and with a base 16 formed of a plurality of contiguous tubular chambers 18, 20, 22, 24, 26 and 28 and end members 30 and 32. A fan 34 supplies air under constant pressure to inflate the structure 10 through inlet tube 36, which communicates with end member 30 of the structure 10. Net panels 38, formed of suitable material, such as nylon, are secured to the vertical tubular members 14, the upper rectangular member 12 and to the base 16. When a child walks about on the contiguous chambers 18, 20, 22, 24, 26 and 28, the changing air pressure tends to distort the shape of the inflatable structure 10, which could result in toppling of the inflatable structure 10 and possible injury to the child. However, the net panels 38 also serve to distribute the distorting forces to adjacent portions of the inflatable structure 10and, hence, serve to prevent toppling. One of the net panels 38 is secured along only one edge to an adjacent vertical member 14 and carries releasable closure means 42 on its free edge 40 which is mateable with corresponding closure means 44 on an adjacent one of the vertical members 14. The closure means 42 and 44 may be slide fasteners, strips of hook-and-loop material or other suitable means for releasably securing the free edge 40 to the adjacent vertical member 14 to serve as a door for allowing persons to enter and leave the structure 10. As seen in FIG. 2, the interiors of the tubular members 18, 20, 22, 24, 26 and 28 of the base 16 have free communication with the interiors of the vertical members 14, which have free communication with the interior of the rectangular upper member 12, as sen at 48 in FIG. 2. However, between the tubular members 18, 20, 22, 24, 26 and 28 of the base 16, suitable flow restricting valve means 48 are provided to permit air flow between the adjacent tubular members of the base 16, but to limit the rate of such flow.

In use, the inflatable structure 10 can be compactly folded for storage and, in this condition, can readily be transported to any desired location. On arrival at a desired location, the user turns on the fan 34, which sends air under constant pressure through inlet tube 36 into end tube 30 of the base 16. From end tube 30, the air flows freely through the tubular members 18, 20, 22, 24, 26, 28 and 23 of the base 16 and through vertical members 14 and the rectangular upper member 12, which serves to 9 inflate and erect the structure 10 to the position shown in FIG. 1. When a child steps through door 40 and puts their weight on the tubular members 18, 20, 22, 24, 26, 28, 30 and 32 of the base 16, the flow restricting valves 48 allow restricted air flow between the adjacent members 18, 20, 22, 24, 26 and 28. thus, the tubular members 18, 20, 22, 24, 26 and 28, which provides a cushioning action. This allows one or more children within the structure 10 to walk about or bounce on the base 16, in a trampoline-like manner, while the vertical members 14 and net panels 38 retain the children within the structure 10and prevent them from bouncing out of the structure 10 to possibly strike and injure themselves on adjacent furniture or other articles. Also, as noted above, the net panels 38 serve to distribute the forces, caused by children walking on the tubular members 18, 20, 22, 24, 26 and 28, and, hence, serve to prevent toppling of the inflatable structure 10 and possible injury to the children. Later, when desired, the structure 10 can be deflated and folded for convenient storage.

Alternatively, the structure 10 can be made in smaller dimensions and the door 40 can be fixedly closed. In this instance, the structure 10 can serve as a portable playpen and parents can place toddlers and babies in the structure 10 by inserting the children through the central open area 15 and placing the children on the base 16 within the structure 10. Thus, the structure 10 ensures that the children cannot wander about and encounter dangerous situations. When the parent wishes to leave the location, they lift the child out of the structure 10 through the central open area 15, deflate the structure 10, fold it compactly and transport it to a new location.

Figure 3:
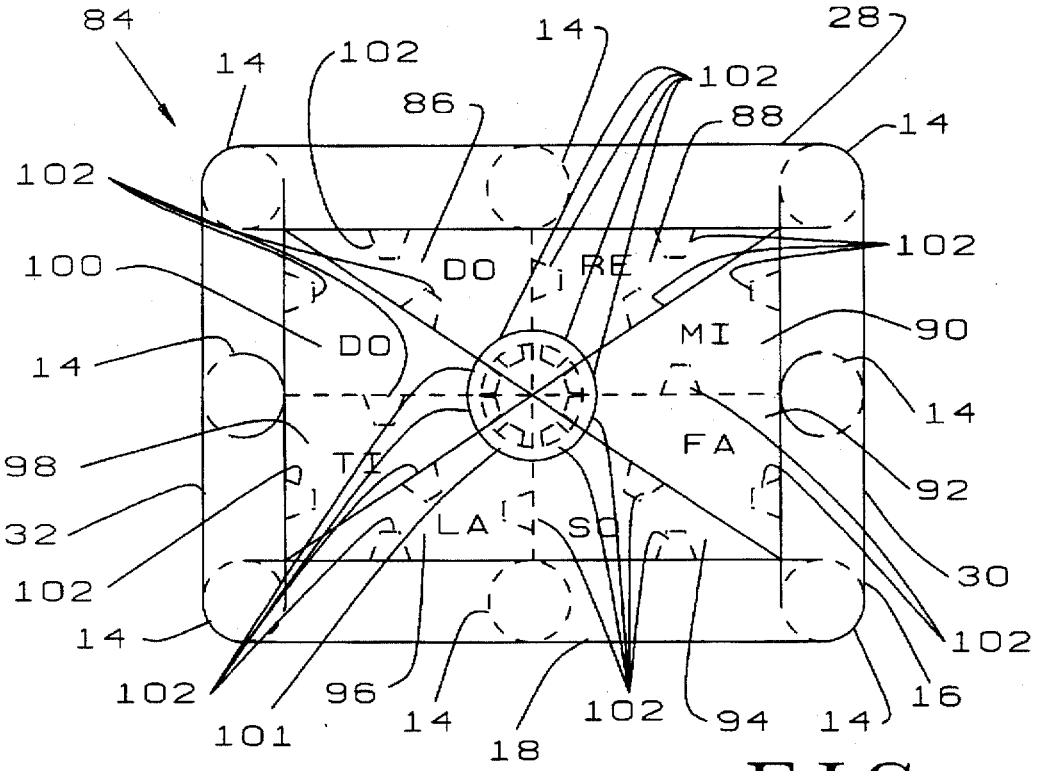
FIG. 3 is a plan view of an alternative form of the inflatable structure of FIG. 1.
Figure 4:
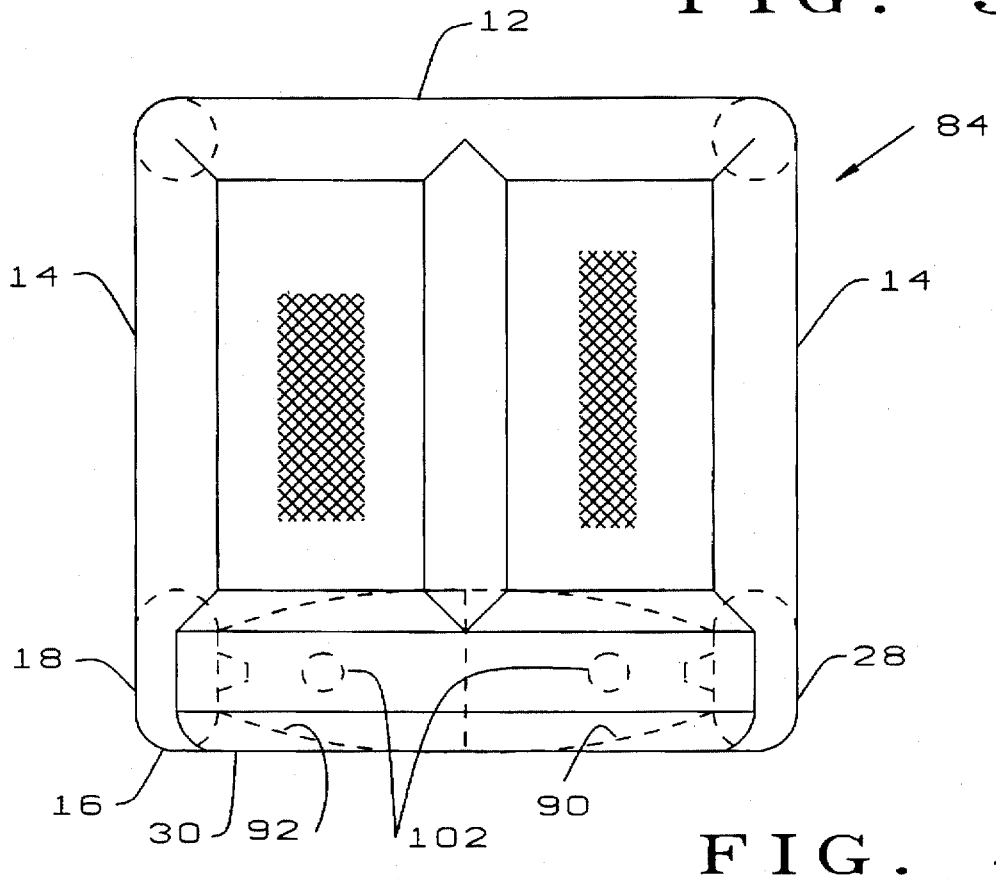
FIG. 4 is a right end view of the inflatable structure of FIG. 3.

FIGS. 3 and 4 show an alternative for, indicated generally at 84, of the inflatable structure 10 of FIG. 1. The inflatable structure 84 is similar to that of FIG. 1 and similar reference numbers are used for similar parts. However, in this form of the present invention, the base 16 has tubular chambers 18, 28, 30 and 32 extending about the periphery of the base 16, while the central portion of the base 16 is formed by a plurality of hollow, generally triangular chambers 88, 90, 92, 94, 96, 98 and 100, which communicate with the tubular chambers 18, 28, 30 and 32, and with a central circular chamber 101, through acoustic air valves 102. The acoustic valves 102 allow air to pass into and out of the adjacent ones of the triangular chambers 88, 90, 92, 94, 96, 98 and 100 from the peripheral chambers 18, 28, 30 and 32 and from the central circular chamber 101. In this way, when a child steps on any one of the triangular chambers 88, 90, 92, 94, 96, 98 and 100 or on the circular central chamber 101, the increased air pressure in the chamber stepped on can redistribute throughout the circular central chamber 101, the adjacent triangular chambers 88, 90, 92, 94, 96, 98 and 100 and the peripheral chambers 18, 28, 30 and 32 in such a manner as to prevent all of the air in the stepped on chamber from escaping and, hence, to prevent the child from sinking completely to the ground. Also each of the acoustic valves 102 emits a sound as air passes through the valve 102. As indicated in FIG. 3, by tuning and appropriate selection, the acoustic valves 102 may be made to each emit a sound corresponding to a respective musical note when air passes into or out of the assosciated one of the triangular chambers 88, 90, 92, 94, 96, 98 or 100. Obviously, if desired, the acoustic valves 102 could be air valves which serve as switches to actuate a remote sound source, a signalling lamp or other appropriate device.

In use, children may play with the inflatable structure 84 in the same manner as described above with respect to the inflatable structure 10 of FIG. 1. In addition, when the children jump on any of the triangular chambers 88, 90, 92, 94, 96, 98 and 100, a musical tone will be emitted by air passing into or out of the respective chambers 88, 90, 92, 94, 96, 98 and 100 through the respective acoustic valves 102. Also, the children can cause the acoustic valves 102 to play a song by jumping on appropriate ones of the triangular chambers 88, 90, 92, 94, 96, 98 and 100. At the same time, the valves 102 serve to allow redistribution of the air pressure among the triangular chambers 88, 90, 92, 94, 96, 98 and 100 and the central circular chamber 101 to prevent a child standing on any of the chambers from sinking completely to the ground.

Figure 5:
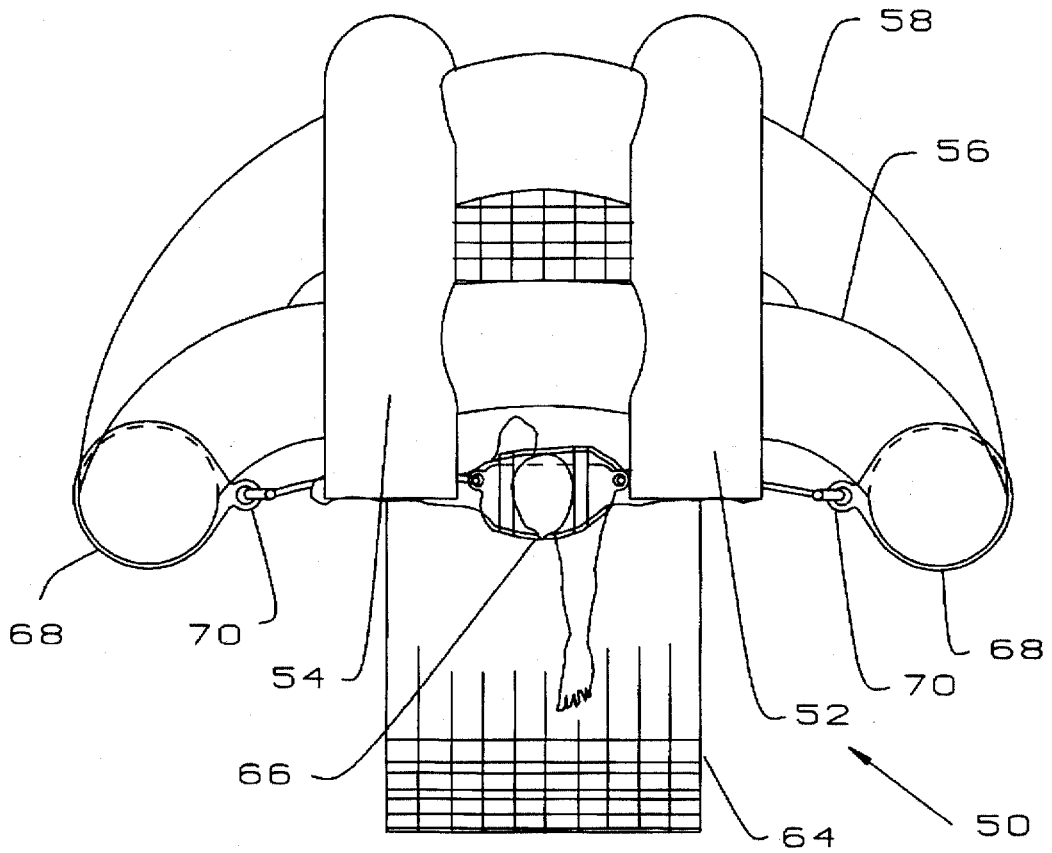
FIG. 5 is a vertical section through an alternative form of the inflatable structure of FIG. 1.
Figure 7:
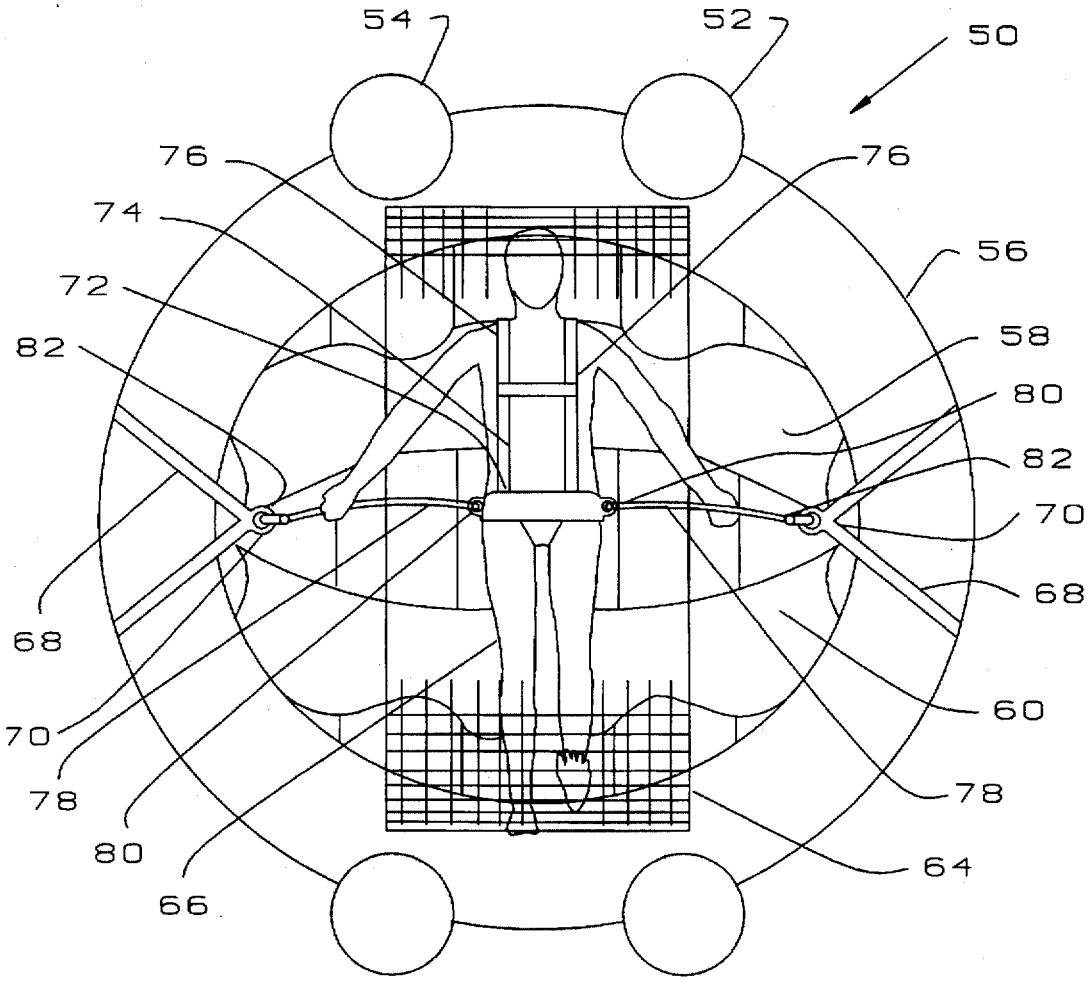
FIG. 7 is a plan view of the inflatable structure of FIG. 5, with parts broken away for clarity.

FIG. 5 is a vertical section through an alternative form, indicated generally at 50, of the inflatable structure of FIG. 1. In this form of the present invention, a pair of circular tubes 52 and 54 are mounted in parallel spaced relation and are joined by a plurality of circular tubes 56, 58, 60 and 62, each having their axis extending perpendicular to the axes of tubes 52 and 54 and each being rotated approximately 30° with respect to the adjacent tubes. As best seen in FIGS. 5 and 7, a net 64, formed of suitable material, such as nylon webbing, extends between the tubes 52 and 54 to form a supporting surface for a person 66. Attaching straps 68 extend about the juncture of the tubes 56, 58, 60 and 62 and each carries a connecting ring 70. The person 66 wears a suitable safety harness 72, having a waist belt 74 and shoulder straps 76, and attaching straps 78 are secured to the waist belt 74 by suitable swivels 80 and have swivel mounted snap hooks 82 releasably connecting the opposite ends of the attaching straps 78 to the connecting rings 70. The tubes 52, 54, 56, 58, 60 and 62 are inflated by suitable means, not shown, to a pressure sufficient to substantially retain their shape even when the person 66 is standing on the supporting surface 64.

In use, the structure 50, when uninflated, can be folded to be quite compact and can easily be carried in a backpack or the like for transportation to a desired location. At the desired location, the tubes 52, 54, 56, 58, 60 and 62 are inflated by suitable means, such as a manual pump. Thereafter, the person 66 steps onto the supporting surface 64, puts on the safety harness 72 and secures the attaching straps 78 to the waist belt 74 and to the connecting rings 70. Thereafter, the person 66 can walk on the supporting surface 64 and the change in location of the weight of the person 66 will cause the structure to roll on the tubes 52 and 54 and, hence, to transport the person 66 within the structure 50. Because the tubes 52, 54, 56, 58, 60 and 62 are inflated, the structure 50 will be quite bouyant and, in fact, will support the person 66 even on water. Thus, by walking on the supporting surface 64, the person 66 can use the structure 50 as a means of transportation across land and water. Upon arrival at a desired destination, for example, after crossing a river, the person 66 can quickly and easily deflate the structure 50 and can restow the structure 50 in a backpack or the like for transportation over land. It will be seen that the structure 50 can serve as an exercise or amusement device on both land and water. Moreover, the structure 50 can serve as an emergency means of transportation for facilitating military personnel to cross rivers and the like, without bridges, boats or other convention means of water transportation.

Figure 6:
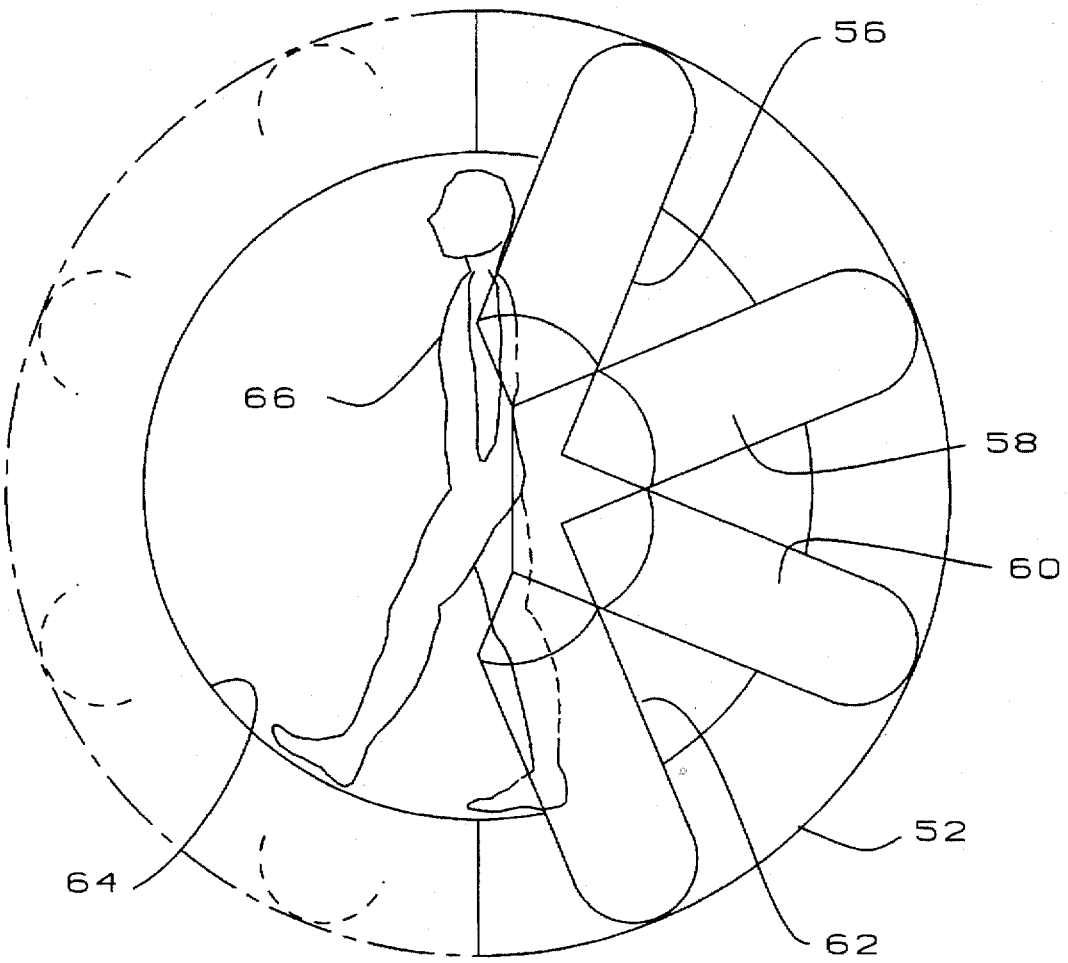
FIG. 6 is a longitudinal section through the inflatable structure of FIG. 5.
Figure 8:
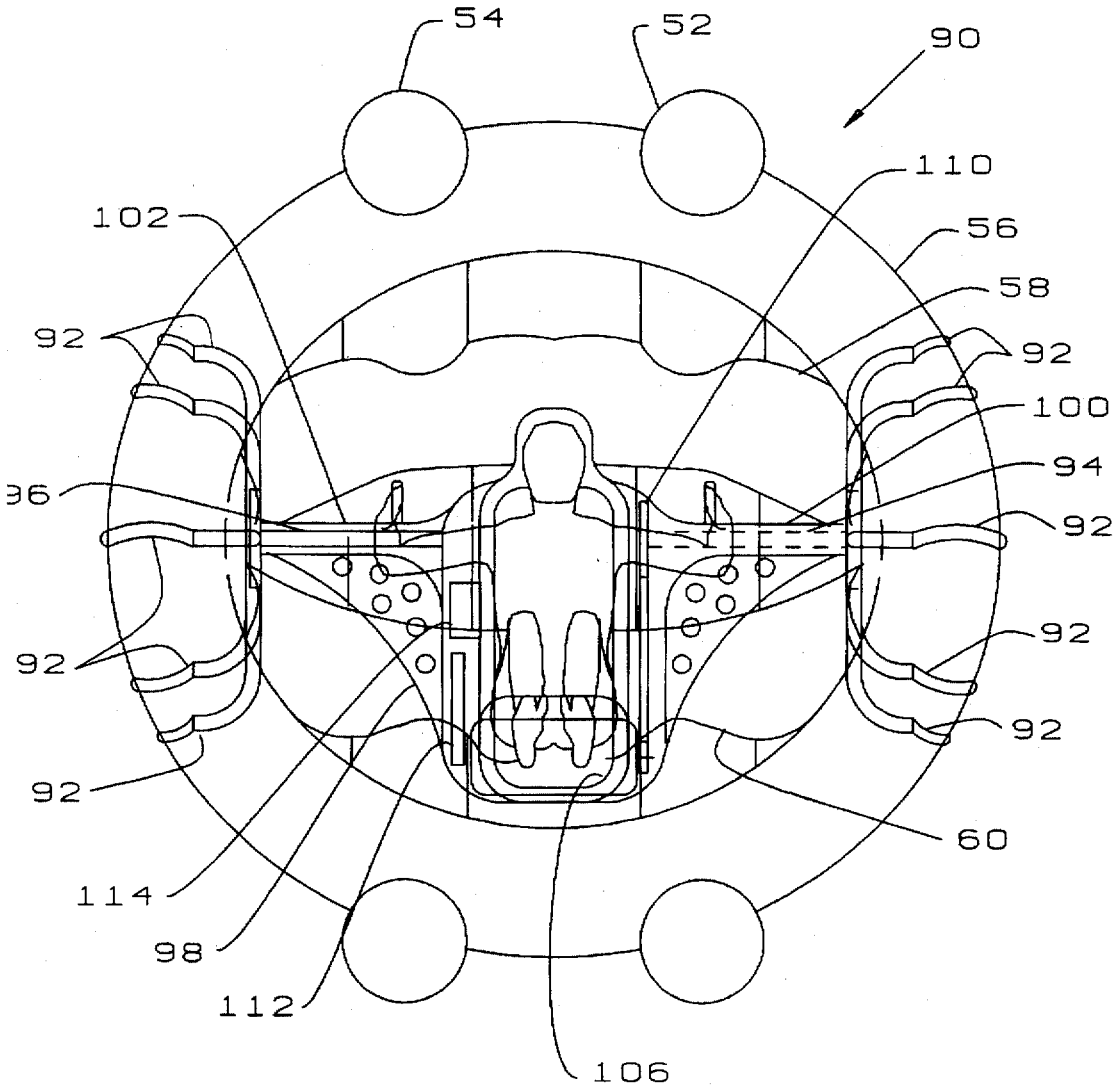
FIG. 8 is a view, similar to that of FIG. 5, showing an alternative form of the inflatable structure of FIG. 5.
Figure 9:
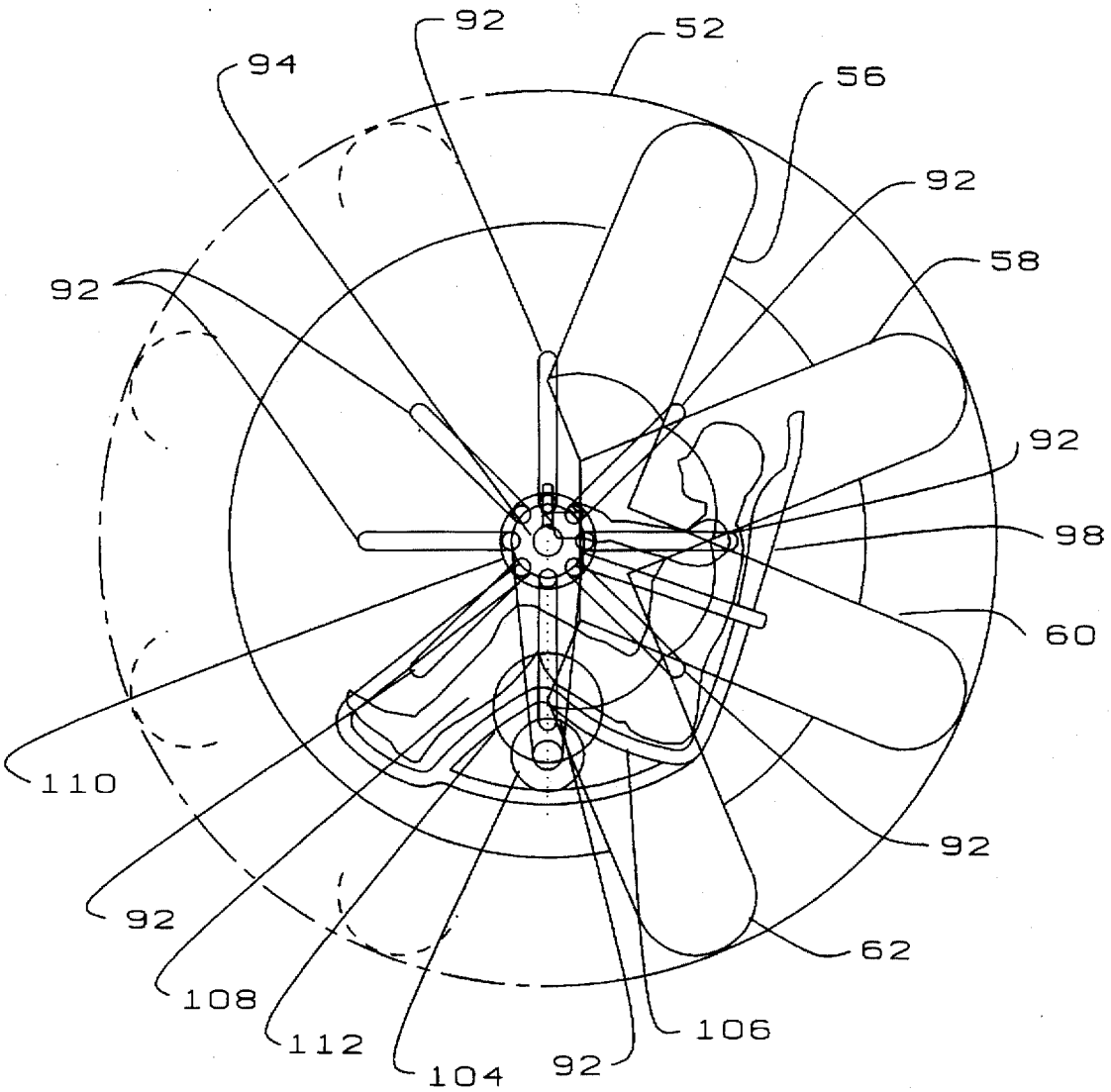
FIG. 9 is a longitudinal section through the inflatable structure of FIG. 8.
Figure 10:
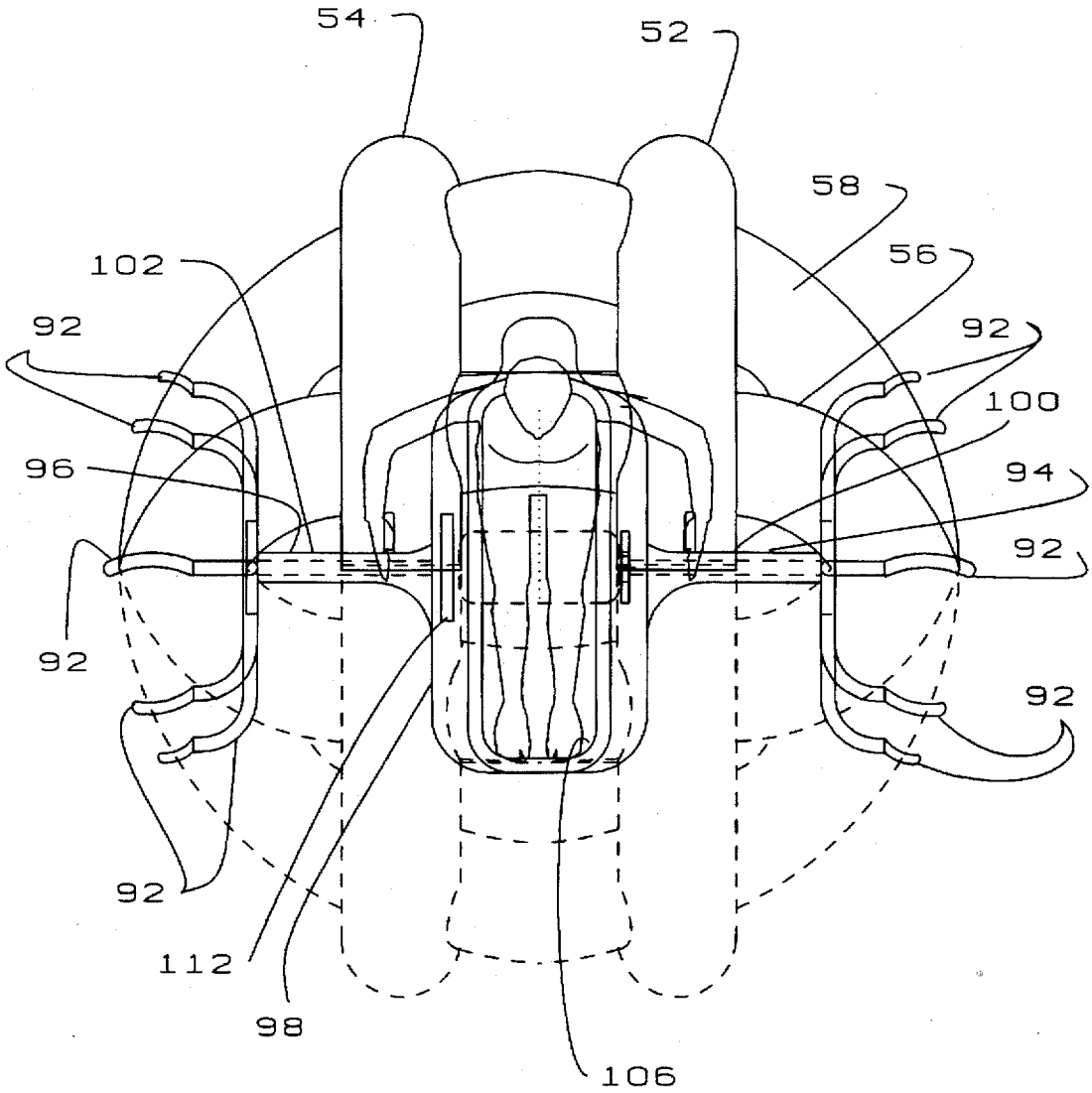
FIG. 10 is a plan view of the inflatable structure of FIG. 8 with parts shown in phantom for clarity.

FIGS. 8, 9 and 10 show an alternative form of the inflatable structure 50 of FIGS. 5, 6 and 7. Indicated generally at 90, this form of the present invention is generally similar to that of FIGS. 5–7, having a pair of circular tubes 52 and 54 mounted in parallel spaced relation and joined by a plurality of circular tubes 56, 58, 60 and 62, each having their axis extending perpendicular to the axes of tubes 52 and 54 and each being rotated approximately 30° with respect to the adjacent tubes. However, the web 64, the attaching straps 68 and safety harness 72–78 of the structure 50 of FIGS. 5–7 are replaced by rigid spider members 92 having shafts 94 and 96 projecting perpendicularly inward from the axis of the spider members 92. A chair 98 has sleeves 100 and 102 encircling the shafts 94 and 96 to suspend the chair 98 and suitable bearings, not shown are provided to permit the sleeves to rotate freely on the shafts 94 and 96. As best seen in FIGS. 9 and 10, a motor 104 is mounted on the chair 98 below the seat 106 and serves to drive a chain or belt 108 which rotates a pulley 110 which is mounted on the inner end of shaft 94 and serves to rotate shaft 94 to propel the inflatable structure 90. A flywheel 112 is mounted between the opposite end of motor 104 and and the chair 98 and serves to stabilize the chair 98. Finally, a control panel 114 is mounted on the chair 98, within easy reach of a person seated on the seat 106, to permit the person to start, stop and regulate the speed of the motor 104 and, hence, of the inflatable structure 90.

What is claimed is:

1. An inflatable recreational structure comprising:

a first pair of circular tubes mounted in parallel, spaced relation and joined by a supporting structure extending therbetween, and a plurality of second tubes lying in planes perpendicular to the axes of said first pair of tubes and each joining said first pair of tubes, said plurality of second circular tubes meeting at a juncture point outside said first tubes and protecting beyond said fist tubes.

2. The inflatable structure of claim 1 further comprising:

safety harness means releasably connectable to said juncture to releasably attach a person to said structure.

3. The inflatable structure of claim 1 wherein:

said structure is sufficiently bouyant to support a person standing on said supporting structure even on water.

4. The structure of claim 1 wherein:

said supporting structure is formed of nylon webbing.

5. The device of claim 1 further comprising:

a pair of spider members connected to said second tubes, and a chair rotatably suspended from said spider members.

6. The device of claim 5 further comprising:

a motor connected to rotate said second tubes.

7. The device of claim 5 further comprising:

means for preventing rotation of said chair with said second tubes.

8. The inflatable structure of claim 1 wherein:

said juncture point lies on a line passing through the centers of said first tubes.

* * * * *